United States Patent [19]

Kirry et al.

[11] Patent Number: 4,798,326

[45] Date of Patent: Jan. 17, 1989

[54] MAIL DELIVERY SIGNALING DEVICE

[76] Inventors: Kenneth R. Kirry, 39 Pleasant St., Apt. 15, Northboro, Mass. 01532; Joseph V. Visconti, 36 N. Main St., Sherborn, Mass. 01770

[21] Appl. No.: 146,424

[22] Filed: Jan. 21, 1988

[51] Int. Cl.[4] ..... B65D 91/00

[52] U.S. Cl. ..... 232/34; 232/35

[58] Field of Search ..... 232/17, 34, 35

[56] References Cited

U.S. PATENT DOCUMENTS

| | | | |
|---|---|---|---|
| 2,433,940 | 1/1948 | Weaver | 232/35 |
| 3,516,383 | 6/1970 | Goddman | 232/35 |
| 4,711,391 | 12/1987 | Roge et al. | 232/35 |

*Primary Examiner*—Robert W. Gibson, Jr.

[57] ABSTRACT

A delivery signaling device having a resilient member capable of bending in a plane tranverse to the mailbox from a signal position in which the member is upright, to a set position, in which the member is bent into a curved shape conforming to the curved top of the mailbox. A clip member is used to attach the resilient member to the side wall of the mailbox. The clip member is formed of resilient material and has inner and outer portions that grip the side wall of the mailbox. A display region visible from a distance is provided at the free end of the resilient member. The resilient member is locked in the set position by a tab member that extends beneath the flange of the mailbox door and downwardly over the edge of the mailbox wall. The resilient member is a sheet material.

9 Claims, 2 Drawing Sheets

FIG. 5b
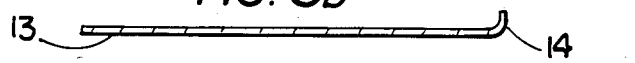
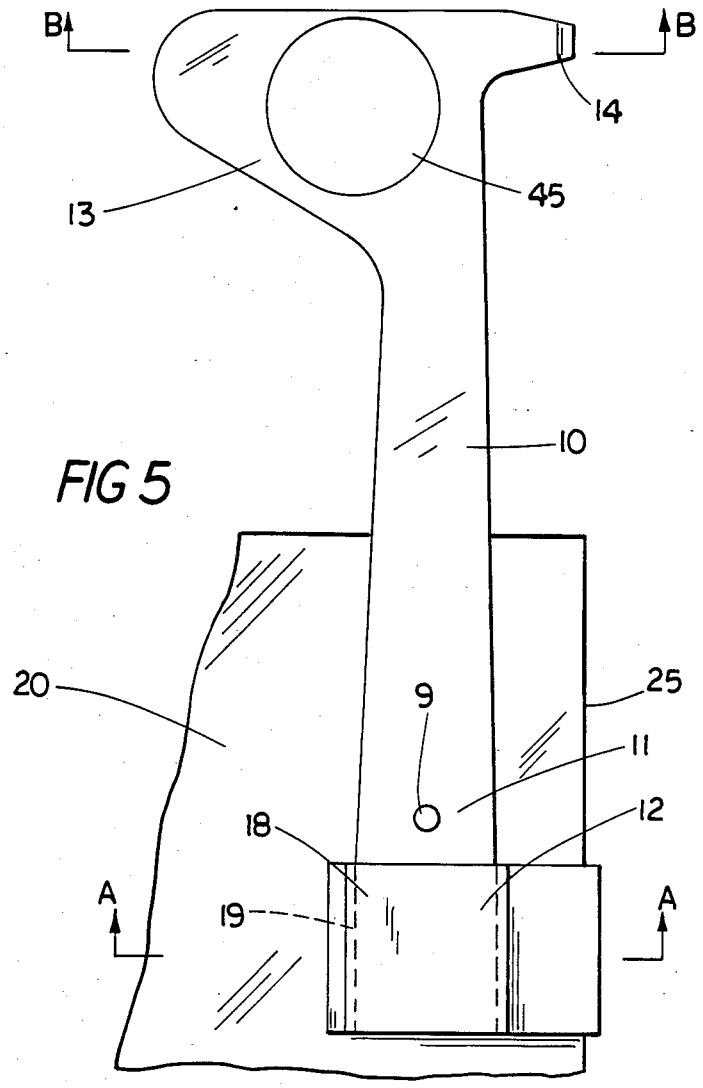
FIG 5
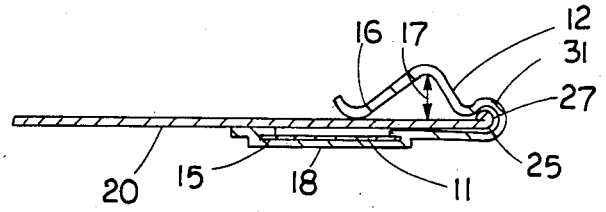
FIG. 5a

MAIL DELIVERY SIGNALING DEVICE

BACKGROUND OF THE INVENTION

This invention relates to devices for signaling to a remote observer that a mail delivery has been made to a standard rural mailbox.

It is desirable in a rural area or in any situation where the mailbox is located some distance from the addressee's residence to have a mail delivery signal visible at some distance from the mailbox. With such a signal in place, a quick look toward the mailbox from the safety and comfort of the residence will inform the addressee that a delivery has been made, so the addressee may be assured of retrieving the items soon after their delivery, without having to make frequent excursions to the box itself. Such a signal is particularly desirable where the addressee is elderly or handicapped or is a family with an infant; or when the mailbox is very distant from the residence or situated in an unsafe place, such as near a dangerous roadway.

A standard rural mailbox is typically tubular in shape, and includes a flat floor, side walls and a top wall merged to form a continuous arcuate enclosure, a wall covering a closed rear end, and a front wall, or door, pivotally mounted to permit opening and closing of a front end, where delivered mail is received and retrieved. Around the edge of the door typically is a flange which overlaps the front edges of the side and top walls. The door is generally held closed by a frictional latch and catch bar, and is left closed except when an object is being placed into, or removed from, the box.

Each time a delivery is made to such a box the delivering person opens the door, and so a number of approaches to mail delivery signal devices have been proposed, in which opening the door releases a visible device from a set position to a generally erect display position, the latter position therefore indicating that a delivery has been made.

SUMMARY OF THE INVENTION

In general, the invention features a delivery signaling device having a resilient member capable of bending in a plane transverse to the mailbox from a signal position in which the member is upright, to a set position. in which the member is bent into a curved shape conforming to the curved top of the mailbox.

In preferred embodiments, a clip member is used to attach the resilient member to the side wall of the mailbox; the clip member is formed of resilient material and has inner and outer portions that grip the side wall of the mailbox; a display region visible from a distance is provided at the free end of the resilient member; the resilient member is locked in the set position by a tab member that extends beneath the flange of the mailbox door and downwardly over the edge of the mailbox wall; the resilient member is a sheet material; the display region is an integral portion of the sheet material; all of the resiliency of the resilient member is provided by the resiliency of the sheet material; the display region is an enlarged area of the sheet material at the free end of the resilient member; the tab portion is bent through an angle greater than 45° from the plane of the resilient member; the clip member is formed of a thermoplastic material (e.g., an extruded plastic); the inner portion of the clip member has a recurved shape.

The mail delivery signaling device of the invention provides, by simple construction and a straightforward mechanism, a clear and attractive visual indication when mail has been delivered. The signal device is easy to operate, and can be set by a child. The device has a single moving part—the resilient member that is bent into a shape conforming to the curved top of the mailbox.

The device fits any size conventional or standard mailbox, and is easily installed without tools and without modification of the box in only a few seconds. The device does not change the overall appearance of the box and does not interfere with the generation of the "mail for pickup" indicator conventionally provided with standard, metal mailboxes. In the set position, with the resilient member conforming to the curved shape of the mailbox, the device is hardly noticeable. Yet in the signal position, the device provides a highly visible indication of mail delivery. All of this is achieved without unsightly and complicated modifications to the mailbox.

Made from appropriate inexpensive and readily available materials, the signal device will remain free of corrosion, erosion, and deterioration over a long period of time, and will provide many years of maintenance-free and trouble-free service.

Without alteration of the device or of the mailbox, the device may be removed as easily as it was installed as a security precaution when, for example, the resident will be away for an extended time.

The signal device may be decorated as desired by the resident to provide greater visibility and to make the signal distinctive where, as is often the case, a number of similar boxes are arranged close together.

Other features and advantages of the invention will be apparent from the description of the preferred embodiment and from the claims.

DESCRIPTION OF THE PREFERRED EMBODIMENT

FIG. 5 is a plan view of the signaling device.

FIG. 5A is a sectional view at A—A in FIG. 5.

FIG. 5B is a sectional view at B—B in FIG. 5.

Figure 1:
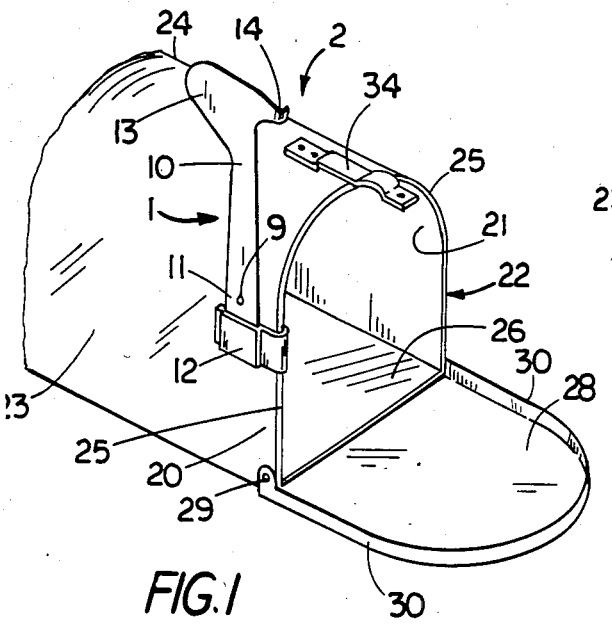
FIG. 1 is a perspective view of a signaling device of the invention installed in a standard rural mailbox.

With reference now to FIG. 1, the signaling device 1 includes a resilient, generally flat, blade shaped member 10 having an attachment end 11 inserted into a clip 12 and, generally opposite the attachment end 11, a display end 13.

Figure 2:
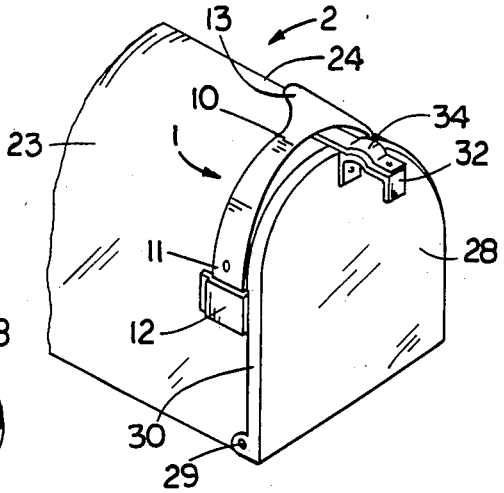
FIG. 2 is a perspective view of the signaling device of FIG. 1, in the "set" position.
Figure 3:
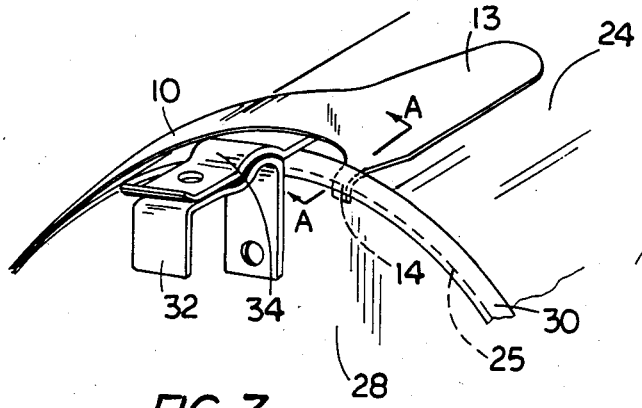
FIG. 3 is a perspective view from a different aspect of the signalling device in the "set" position.
Figure 4:
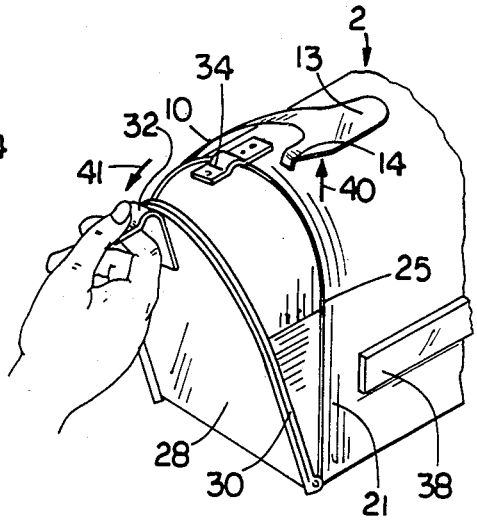
FIG. 4 is a perspective view showing the signaling device being released from the "set" position as the mailbox door is opened.

A standard rural mailbox, part of which is shown generally at 2 in FIGS. 1 through 4, is generally as described above, having a flat floor 26, side walls 20, 21 merging with curved top wall 24 to form an arcuate enclosure, a back wall (not shown in the figures) and a door 28 pivotally mounted at 29 near floor 26 of the mailbox and having a flange 30 which overlaps edges 25 at open end 22 of the mailbox when door 28 is closed, as shown in FIGS. 2 and 3. Door 28 is kept frictionally closed by frictional interaction of latch 32 attached to door 28 with catch bar 34 attached to wall 24.

Signaling device 1 is installed by mounting the clip 12 onto a portion of a wall 20 near the open end 22 of the mailbox, in a manner described in detail below. Owing to its resiliency, blade-shaped member 10 remains in a generally upright erect position, as shown in FIG. 1, so that display end 13 can be seen, unobstructed by mailbox 2 from nearly any direction, unless some force is applied against the resilience to flex display end 13 away from view, as shown, e.g., in FIGS. 2 and 3.

With reference now to FIG. 5, blade-shaped member 10 is made of a suitable sheet material capable of being flexed as shown in FIGS. 2 and 3, yet sufficiently resilient and strong to stay in a substantially erect and vertical position when installed as shown in FIG. 1. Preferably member 10 is stamped from sheet stock stainless steel, most preferably "301 Stainless". Member 10 is sufficiently long that when the device is mounted as shown in FIG. 1 and is in its substantially erect display position, display end 13 projects above top wall 24 of the mailbox.

Figure 3A:
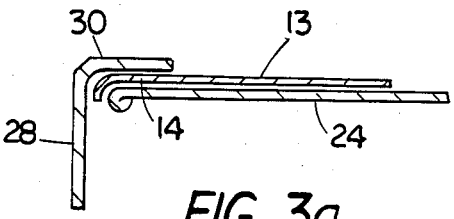
FIG. 3A is a sectional view of A—A in FIG. 3.

A tab portion 14 projects from member 10, and is bent near its tip as shown in FIG. 5B. This tab portion engages an edge 25 of wall 24 and is held in the clearance space between edge 25 and flange 30 of door 28 when the signal device is in the set position, as shown in FIGS. 2 and 3 and described more fully below. As shown in FIG. 3A the tab portion is bent downwardly at its tip over the edge of the mailbox wall. The bend is preferably more than 45° (most preferably about 90°) to achieve reliable locking.

As is more clearly shown in FIG. 5A, clip 12 is shaped so as to provide both a secure attachment to end 11 of blade-shaped member 10 and a firm clamping grip on wall 20 of the mailbox when installed thereon. To provide attachment to member 10, a blade-receiving portion 18 of clip 12 is provided with a slot 15. Slot 15 is dimensioned such that end 11 fits tightly when inserted wherein. Clip 12 is made from a strongly resilient material, and recurved portion 16 of clip 12 is formed so that this material resiliency provides a resilient bias tending to shorten distance 17 and thereby tending to provide a clamping force between recurved portion 16 and flattened blade-receiving portion 18. To assemble the device, attachment end 11 of blade shaped member 10 is inserted into open slot 15 in clip 12. The completed assembly is shown in FIG. 5, a broken line 19 indicating the outline of fully inserted end 11 which also is shown in sectional view in FIG. 5A. The tight pressure fit provided by slot 15 for end 11 of member 10 renders member 10 and clip 12 immovably joined when insertion is complete.

The clip 12 may be made of any suitable material meeting these structural requirements, preferably a high impact plastic, and most preferably BF Goodrich GEON 85857 extruded plastic.

A hole 9 (FIG. 1) is provided to permit the user to permanently secure the device to the mailbox to prevent theft or other disturbance to the device.

A vinyl, colored circle 45 is applied to both sides of the display end of the device (FIG. 5) to improve visibility.

Signal device 1 is installed on a standard mailbox by forcing clip 12 over an edge 25 at the open end of wall 20, so that wall 20 passes between recurved portion 16 and flattened portion 18 of clip 12 and spreads them apart against the resilient bias between them. As may be more clearly seen in Figs. 5 and 5A, once the clip has been pressed fully over edge 25 of wall 20 it is gripped firmly by the clamping force provided by recurved portion 16. In some standard mailboxes, edge 25 is provided with a bead 27, which seats firmly within cylindrically-curved portion 31 of clip 12. Clip 12 is positioned well up on the vertical portion 20 of the mailbox wall, so that in the substantially erect display position shown in FIG. 1, display portion 13 is clearly visible above top wall 24 of the mailbox.

When the recipient addressee retrieves items delivered to the mailbox, the box (with the door open) and signal device (in its display position) appear as in FIG. 1. To "set" the signal for the next delivery the display end 13 of member 10 is pressed over and across top wall 24 and over catch bar 34 until the tab portion 14 is brought into contact with edge 25 of wall 24, and then door 28 is closed so that tab 14 is caught between flange 30 of door 28 and edge 25 of wall 24, as shown in FIG. 2. This "set" position can be seen more clearly in FIG. 3, where edge 25 and tab 14 are shown beneath flange 30 as broken lines.

Signal device 1 will remain in this "set" position as shown in FIGS. 2 and 3 until the door is again opened, as by a delivery person depositing mail. When the door is opened, as shown by arrow 41 in FIG. 4, the tab 14 is released from its confinement between edge 25 and flange 30, and the restoring force of resiliency in member 10 causes display end 13 to spring, as shown by arrow 40, again toward its substantially erect display position, where it will remain until it is reset into the "set" position, as by one retrieving the deposited mail.

As will be evident from the foregoing description, the signal, once set by the addressee-user, operates automatically, that is to say, with no special intervention by the delivery person.

OTHER EMBODIMENTS

Other embodiments are within the following claims. For example, the entire signal device can be made as a single piece comprising blade and clip; it may for example be injection molded as one piece of a suitable material providing the required resiliency and strength. Or, alternatively, no clip need be used, the attachment end 11 of blade member 10 being directly fastened by means of a screw, rivet, or bolt, for which an attachment hole 19 is provided; this is less preferable, because installment requires tools and extra parts and because it requires a modification to the mailbox itself.

One skilled in the art will appreciate that any of a variety of materials may be used to manufacture the device of the invention.

Display portion 13 may be decorated to improve visibility and distinctiveness by application of, for example, paint or decals.

The signal device can be assembled in a mirror-image fashion and installed with the clip on the right hand wall 21 of the mailbox rather than on the left-hand wall 20; this is less preferred, because in that orientation the signal device interferes with the customary "mail-for pickup" indicator 38 which is commonly provided with standard rural mailboxes.

We claim:

1. A delivery signaling device for use in conjunction with a standard rural mailbox of the type that is generally tubular in shape, having a bottom wall, two side walls, a curved top wall, and an open end, and having a pivotally mounted door capable of movement from a closed to an open position for the insertion and retrieval of mail from said box, said door having a flange that overlaps the edges of said walls at said open end when said door is in the closed position, said device comprising a resilient member adapted to resiliently bend in a plane transverse to said mailbox from a signal position, in which said member stands upright, to a set position, in which said member is bent into a curved shape conforming to the curved top wall of said box, and further comprising a clip member to which the lower end of said resilient member is attached, said clip member being inherently resilient and comprising an outer member, to which said resilient member is attached and which is adapted to remain on the outside surface of said box, and an inner member joined to said outer member at a bend region, said inner and outer members and bend region shaped and positioned to permit said clip member to be slid onto a side wall of said box with said inner and outer members providing a gripping force on said side wall to retain said clip member on said box, and wherein said resilient member has a display region at its free end, said display region being sized and positioned so as to be visible to the user from a distance, thereby to provide an indication that mail has been delivered to said box, and wherein said resilient member has a tab portion extending from its free end in the direction of said door and a downwardly directed portion adapted to extend over an edge of one of said walls when said resilient member is in said set position, said tab portion being shaped and positioned so as to be confined between said door and the edge of said wall so long as said door remains closed, and so as to be released from confinement when said door is moved to said open position, and wherein said resilient member is a sheet material with its thin dimension generally normal to said walls of said box.

2. The device of claim 1 wherein said display region is an integral portion of said sheet material.

3. The device of claim 2 wherein all of the resiliency of said resilient member is provided by the resiliency of said sheet material.

4. The device of claim 3 wherein said display region is an enlarged area of said sheet material at said free end of said resilient member.

5. The device of claim 1 wherein said downwardly-directed portion comprises a band in said tab portion bent through an angle greater than 45° from the plane of said resilient member.

6. The device of claim 5 wherein said bend is about 90°.

7. A delivery signaling device for use in conjunction with a standard rural mailbox of the type that is generally tubular in shape, having a bottom wall, two side walls, a curved top wall, and an open end, and having a pivotally mounted door capable of movement from a closed to an open position for the insertion and retrieval of mail from said box, said door having a flange that overlaps the edges of said walls at said open end when said door is in the closed position, said device comprising a resilient member adapted to resiliently bend in a plane transverse to said mailbox from a signal position, in which said member stands upright, to a set position, in which said member is bent into a curved shape conforming to the curved top wall of said box, and further comprising a clip member to which the lower end of said resilient member is attached, said clip member being inherently resilient and comprising an outer member, to which said resilient member is attached and which is adapted to remain on the outside surface of said box, and an inner member joined to said outer member at a bend region, said inner and outer members and bend region shaped and positioned to permit said clip member to be slid onto a side wall of said box with said inner and outer members providing a gripping force on said side wall to retain said clip member on said box, and wherein said resilient member has a display region at its free end, said display region being sized and positioned so as to be visible to the user from a distance, thereby to provide an indication that mail has been delivered to said box, and wherein said resilient member has a tab portion extending from its free end in the direction of said door and a downwardly directed portion adapted to extend over an edge of one of said walls when said resilient member is in said set position, said tab portion being shaped and positioned so as to be confined between said door and the edge of said wall so long as said door remains closed, and so as to be released from confinement when said door is moved to said open position, and wherein said clip member is formed of a thermoplastic material.

8. The device of claim 7 wherein said clip member is an extruded plastic member.

9. The device of claim 8 wherein said inner member of said clip member has a recurved portion.

* * * * *